US007033217B2

(12) United States Patent
Mase et al.

(10) Patent No.: US 7,033,217 B2
(45) Date of Patent: Apr. 25, 2006

(54) CONNECTOR

(75) Inventors: Tsuyoshi Mase, Yokkaichi (JP); Tsutomu Tanaka, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/979,719

(22) Filed: Nov. 2, 2004

(65) Prior Publication Data

US 2005/0095911 A1 May 5, 2005

(30) Foreign Application Priority Data

Nov. 5, 2003 (JP) ..... 2003-375925

(51) Int. Cl.
*H01R 13/40* (2006.01)

(52) U.S. Cl. ..... 439/595

(58) Field of Classification Search ..... 439/595, 439/752, 851–852, 744

See application file for complete search history.

(56) References Cited

U.S. PATENT DOCUMENTS

| | | | | |
|---|---|---|---|---|
| 5,788,536 | A | 8/1998 | Matsuura et al. | |
| 6,390,849 | B1 | 5/2002 | Yamanashi et al. | |
| 6,527,579 | B1 | 3/2003 | Sato et al. | |
| 6,692,302 | B1 * | 2/2004 | Tsuji et al. | 439/595 |
| 6,851,976 | B1 * | 2/2005 | Ichida et al. | 439/595 |
| 2002/0106937 | A1 * | 8/2002 | Ichio et al. | 439/595 |

FOREIGN PATENT DOCUMENTS

| | | |
|---|---|---|
| JP | 2003-257531 | 9/2003 |

* cited by examiner

*Primary Examiner*—J. F. Duverne
(74) *Attorney, Agent, or Firm*—Gerald E. Hespos; Anthony J. Casella

(57) ABSTRACT

A connector has a resin housing (10) molded with a cavity (11) for receiving a terminal fitting (30). A lock (16) is molded adjacent the cavity (11) and is configured to lock the terminal fitting (16). A mold-removal space (19) is formed during the molding of the lock (16). The terminal fitting (30) has a stabilizer (35) that can enter the mold-removal space (19). A protrusion (21) is formed in the mold-removal space (19) and can be engaged by the stabilizer (35) to limit inclination of the terminal fitting (30) in the cavity (11).

13 Claims, 5 Drawing Sheets

COMP. EXAMPLE

CONNECTOR

BACKGROUND OF THE INVENTION

1. Field of the Invention

The invention relates to a connector.

2. Description of the Related Art

U.S. Pat. No. 6,527,579 discloses a connector with a housing formed from a synthetic resin. Cavities are formed in the housing and resin locks extend along inner walls of the cavities. Terminal fittings can be inserted into the cavities and are held by the locks.

The terminal fitting is inserted into the cavity of the above-described connector by holding a wire. The lock deforms resiliently at an intermediate stage of the insertion and slides in contact with the outer surface of the terminal fitting. Thus, an insertion resistance is created due to friction between the lock and the terminal fitting. A clearance is defined between the inner wall of the cavity and the outer surface of the terminal fitting to reduce a sliding resistance between the inner wall of the cavity and the terminal fitting. However, the clearance between the cavity and the terminal fitting causes the terminal fitting to shake in the cavity. The clearance takes substantially the same dimensions regardless of the size of the connector. Thus, an angle of inclination of the terminal fitting during shaking is relatively small if the connector and the terminal fitting are large. Accordingly, shaking does not hinder the contact while mating large terminal fittings. However, an angle of inclination of the terminal fittings during shaking is relatively large for a miniature connector, and such shaking can hinder the contact while mating small terminal fittings.

The invention was developed in view of the above problem, and an object thereof is to suppress the inclination of a terminal fitting in a cavity.

SUMMARY OF THE INVENTION

The invention relates to a connector with a housing formed from a synthetic resin. At least one cavity is formed in the housing and a lock extends substantially along an inner wall of the cavity. A terminal fitting can be inserted into the cavity. The terminal fitting is engaged by the lock and held so as not to come out. The terminal fitting has at least one projection that can enter a mold-removal space that is formed while molding the lock. At least one protrusion is formed on the inner wall of the mold-removal space and for contacting the projection.

Inclination of the terminal fitting in the cavity can be suppressed by forming the protrusion in the mold-removal space and by bringing the projection of the terminal fitting into contact with the protrusion. Further, the inclination of the terminal fitting is prevented by using the mold-removal space that is formed while molding the lock. Thus, the shape and construction of the connector is simple than if a separate element is used exclusively to prevent the inclination.

The terminal fitting preferably has at least one stabilizer for preventing the terminal fitting from being inserted into the cavity in an improper posture. The stabilizer preferably serves as the projection. Thus, the shape of the terminal fitting is simpler than a case where a projection is separate from the stabilizer.

The protrusion preferably is a long narrow rib that extends substantially parallel with an inserting direction of the terminal fitting into the cavity. Thus, a sliding resistance between the protrusion and the projection is small even if the projection contacts the protrusion while inserting the terminal fitting.

A projecting distance of the protrusion preferably is larger than the clearance between the terminal fitting and the cavity and/or substantially equal to the thickness of the projection.

An outer surface of the mold-removal space preferably is more outward than the side surface of the cavity.

An escaping space preferably is formed by recessing a side surface of the mold-removal space to widen the mold-removal space along a widthwise direction.

A clearance between the projection and an inner side surface of the escaping space and a clearance between the outer side surface of the projection and the protrusion preferably are substantially equal to a clearance between the outer surface of a substantially rectangular tube portion of the terminal fitting and the inner surface of the cavity.

A projecting distance of the protrusion preferably is larger than the clearance between the terminal fitting and the cavity and/or is substantially equal to the thickness of the projection.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 1:
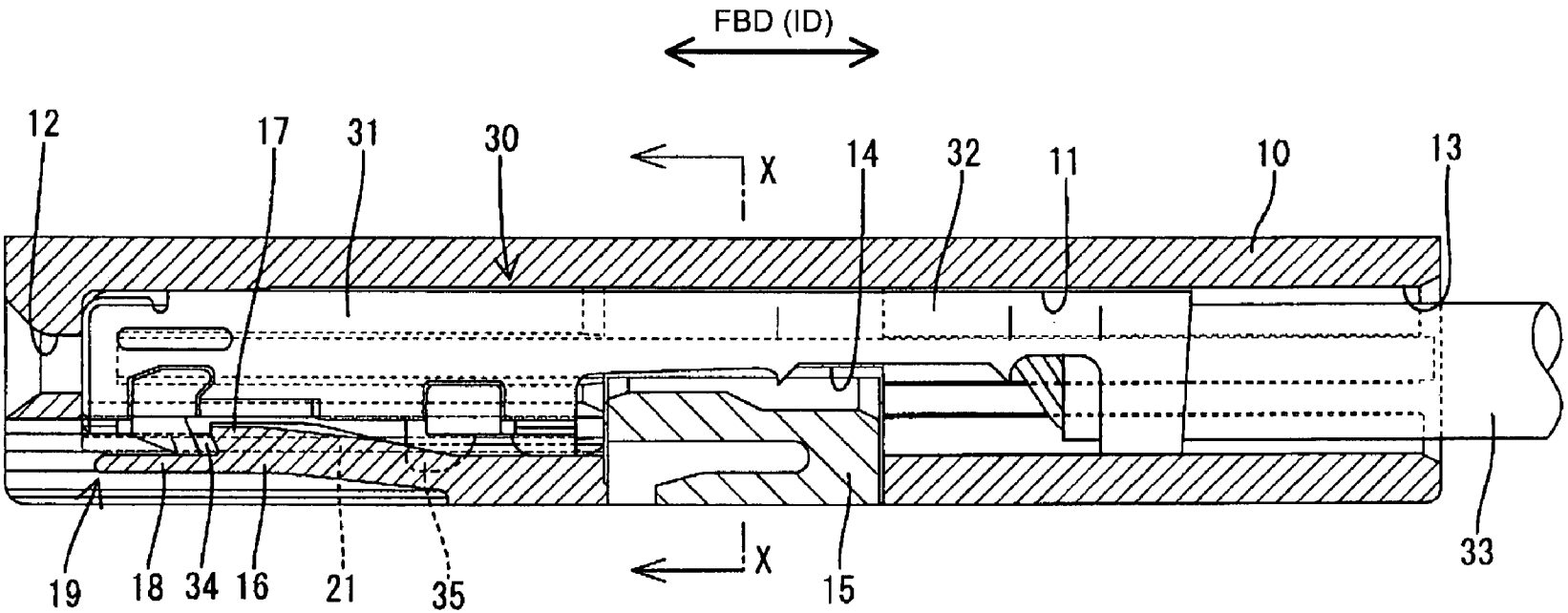
FIG. 1 is a longitudinal section of one preferred embodiment of the invention.
Figure 2:
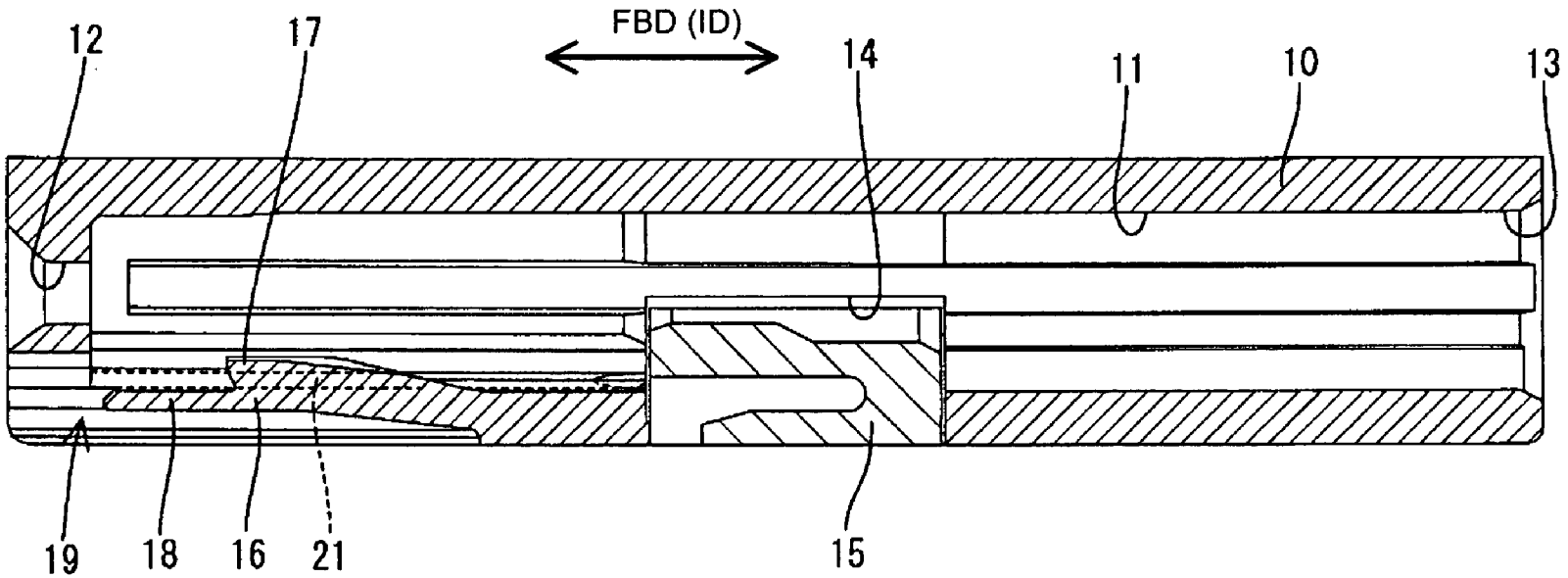
FIG. 2 is a longitudinal section showing a state where a terminal fitting is not inserted.
Figure 3:
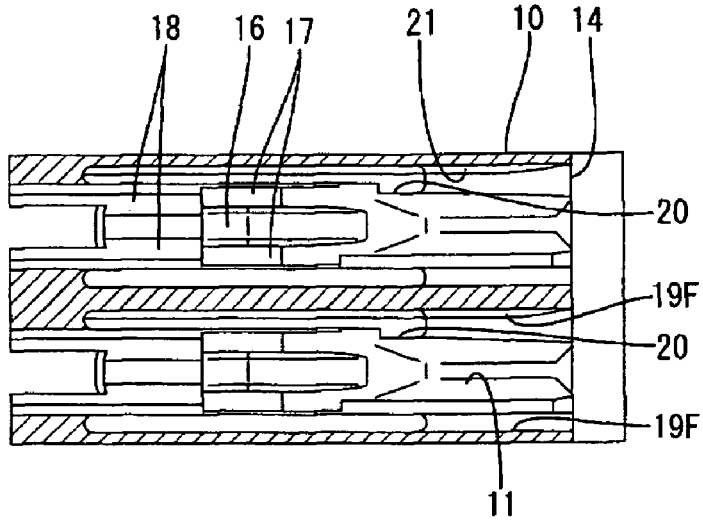
FIG. 3 is a horizontal section showing a state where the terminal fitting is not inserted.

A connector according to the invention is illustrated in FIGS. 1 to 6. The connector includes a housing 10 made e.g. of a synthetic resin. The end of the connector that mates with an unillustrated mating connector (left side of FIGS. 1 to 3) is referred to herein as the front. The terms upper, lower, top and bottom are used herein as a convenient frame of reference, but are not intended to imply a required gravitational orientation.

Cavities 11 penetrate the housing 10 from the front end to the rear end. The cavities 11 are long and narrow along forward and backward directions FBD are arranged substantially side by side to. Each cavity 11 has a substantially rectangular cross section along a direction normal to the forward and backward directions FBD, and has a height that is slightly larger than the width. The front end of the cavity 11 is narrowed to define a smaller tab insertion opening 12 through which a narrow tab (not shown) of a mating terminal can be inserted. The cavity 11 also has a terminal insertion opening 13 at the rear end of the housing 10. An accommodation space 14 is formed in the bottom surface of the housing 10 and communicates with the cavities 11. The accommodation space 14 is located in an intermediate portion of the cavities 11 along forward and backward directions FBD and accommodates a retainer 15.

A lock 16 is formed unitarily on the bottom wall of each cavity 11 and is resiliently deformable substantially vertically in directions substantially normal to the inserting direction ID of the terminal fitting 30 into the cavity 11. The lock 16 is substantially in the form of a flat plate that is narrower than the cavity 11. Two substantially rib-shaped locking projections 17 are formed at the opposite left and right edges of the upper surface of the lock 16 and extend along the forward and backward directions FBD. The rear end of the lock 16 is continuous with the bottom wall of the cavity 11 over substantially the entire width, and two supports 18 extend forward from the opposite left and right sides of the front end of the lock 16. Thus, the lock 16 is supported in the cavity 11 at both the front and rear ends, and an intermediate part with respect to the forward and backward directions FBD can curve down.

Two long narrow mold-removal spaces 19 are formed in the housing 10 and extend along the opposite side surfaces of the lock 16. Each mold-removal space 19 has a vertically long narrow rectangular cross section, see e.g. FIGS. 4 and 5. The upper ends of the mold-removal spaces 19 are above the bottom walls of the cavities 11 and above the upper surfaces of the lock 16, and communicate with the left and right ends of the bottom end of the corresponding cavities 11. The locks 16 are narrower than the cavities 11, as described above. Thus, the width of the mold-removal spaces 19 may be narrowed. However, the side surface of each mold-removal space 19 opposite from the lock 16 is more outward than the side surface of the cavity 11. Therefore, the mold-removal space 19 is wide and leads to an increased stronger mold (not shown) for forming the mold-removal space 19. More particularly, the outer surface of each mold-removal space 19 is positioned in a widthwise direction WD normal to the inserting direction ID more outward than the sidewall of the cavity 11.

Each mold-removal space 19 is open only in the rear end of the housing 10, and is divided by the accommodation space 14 into a front area 19F and a rear area (not shown). The lock 16 faces the front area 19F. An escaping space 20 is formed by lightly recessing the side surface of the lock 16 at a rear part of the front area 19F of the mold-removal space 19. The escaping space 20 extends from a position corresponding to the rear end of the lock 16 to the accommodation space 14 and widens the mold-removal space 19 along the widthwise direction WD.

A rib-shaped protrusion 21 is formed on a side surface of the right mold-removal space 19 opposite from the lock 16. The protrusion 21 extends substantially straight along forward and backward directions FBD and has a substantially rounded cross section along a direction normal to forward and backward directions FBD. The protrusion 21 extends over substantially the entire front area 19F before the accommodation space 14.

The connector further includes terminal fittings 30. A metallic plate material with a specified shape is bent, embossed, folded, stamped and/or cut to form each terminal fitting 30. A substantially rectangular tube 31 is formed at substantially a front half of the terminal fitting 30 and a wire-crimping portion 32 is formed at substantially a rear half. The wire-crimping portion 32 is crimped, bent or folded into connection with the front end of a wire 33 to electrically connect the terminal fitting 30. A front portion of the bottom wall of the rectangular tube 31 is embossed down to form a fastening projection 34. The fastening projection 34 engages the locking projection 17 of the lock 16 so that the properly inserted terminal fitting 30 is held in the cavity 11.

A plate-shaped stabilizer 35 extends unitarily down from the bottom of the right wall of the rectangular tube 31 and is narrower than the mold-removal spaces 19. The stabilizer 35 enters the rear of the right mold-removal space 19 and the accommodation space 14 in the process of inserting the terminal fitting 30 into the cavity 30 in the inserting direction ID, and then passes the accommodation space 14. The stabilizer 35 is in the escaping space 20 at the rear of the front area 19F of the right mold-removal 19 and behind the locking projection 17 of the lock 16 when the terminal fitting 30 reaches the proper position.

Figure 4:
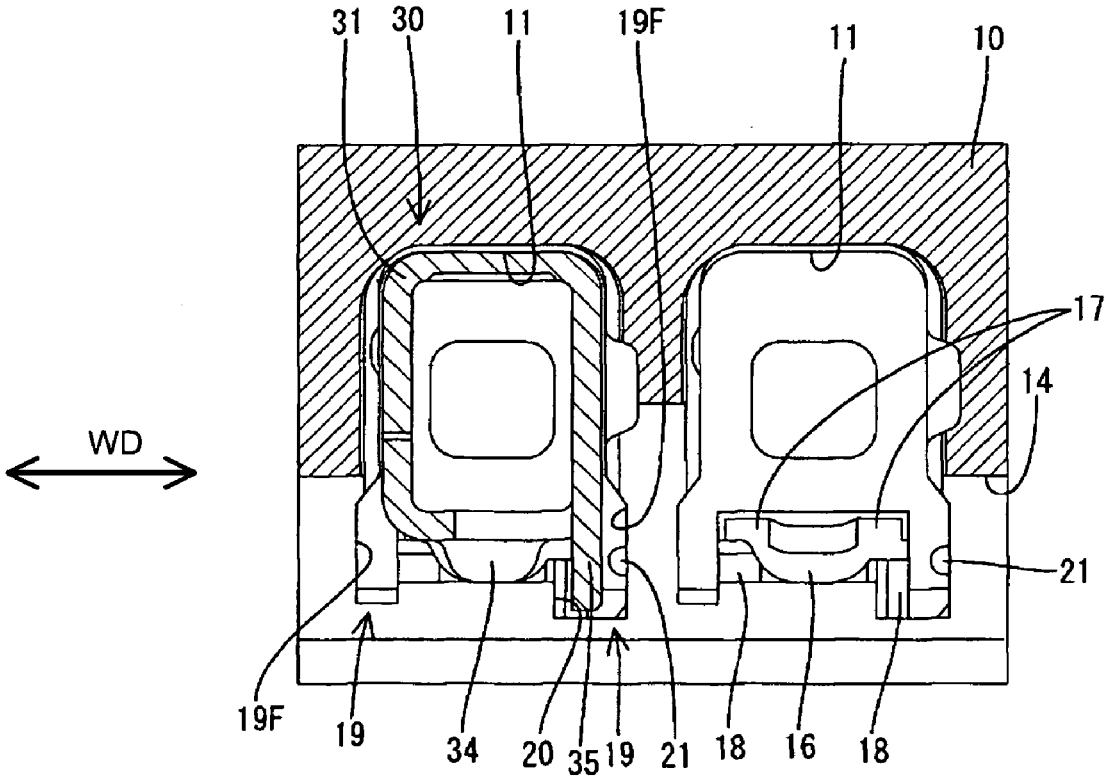
FIG. 4 is a section along 4—4 of FIG. 1.

In a state where the properly inserted terminal fitting 30 is neither transversely inclined nor transversely displaced with respect to the cavity 11, the inner side surface of the stabilizer 35 is parallel to and slightly spaced from the inner side surface of the escaping space 20, and the outer side surface of the stabilizer 35 faces and is slightly spaced from the protrusion 21 as shown in FIG. 4. The clearance between the inner side surface of the stabilizer 35 and the inner side surface of the escaping space 20 and the clearance between the outer side surface of the stabilizer 35 and the protrusion 21 preferably are substantially equal to a clearance between the outer surface of the rectangular tube 31 of the terminal fitting 30 and the inner surface of the cavity 11. A projecting distance of the protrusion 21 is larger than the clearance between the terminal fitting 30 and the cavity 11 and substantially equal to the thickness of the stabilizer 35.

An attempt could be made to insert the terminal fitting 30 in an improper posture, e.g. an upside-down posture or transversely inclined posture with respect to a proper inserting posture. In this situation, the stabilizer 35 will contact the rear end surface of the housing 10 without being able to enter the mold-removal space 19. Thus, the terminal fitting 30 cannot be inserted into the cavity 11 in the improper posture.

The terminal fitting 30 is inserted by holding the wire 33. After sufficient insertion, the rectangular tube 31 engages the lock 16. As a result, the lock 16 deforms resiliently and slides in contact with the bottom surface of the terminal fitting 30. An insertion resistance is created due to friction between the lock 16 and the terminal fitting 30. Accordingly, to reduce the insertion resistance (i.e. sliding resistance between the inner wall of the cavity 11 and the terminal fitting 30), the clearance is defined between the inner wall of the cavity 11 and the outer surface of the terminal fitting 30 as described above. However, the clearance may cause the terminal fitting 30 in shake in the cavity 11, and to make a transverse movement (see FIG. 6).

Figure 5:
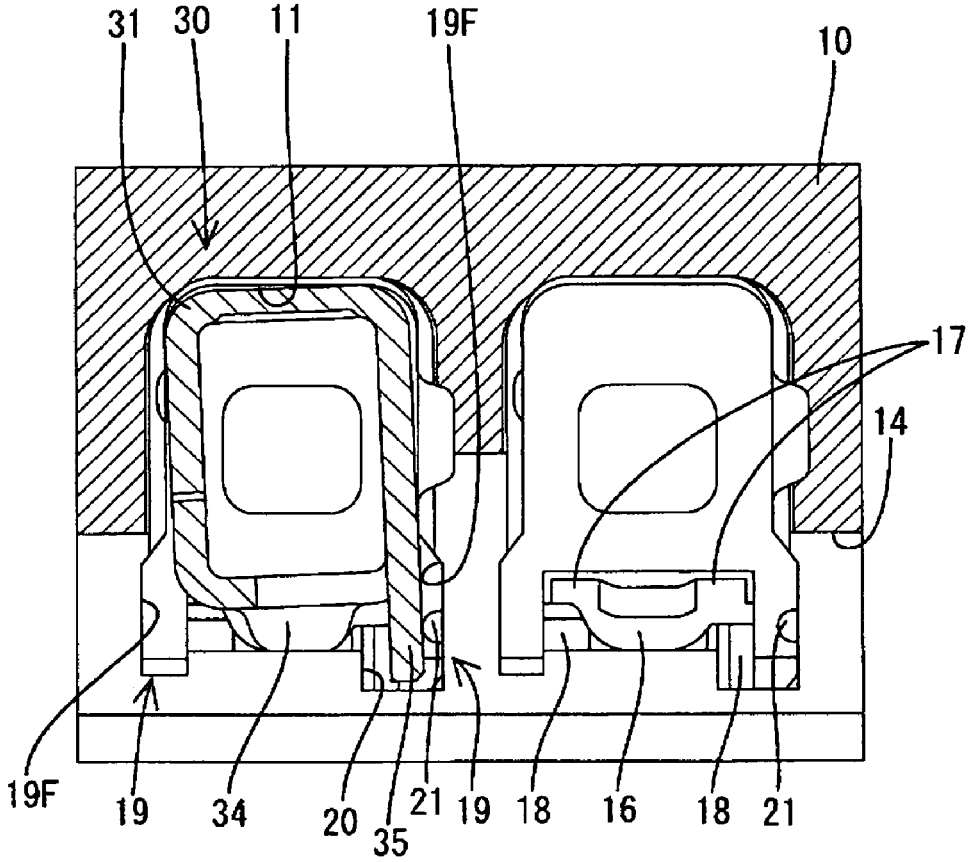
FIG. 5 is a section similar to FIG. 4, but showing a state where the inclination of the terminal fitting is suppressed.
Figure 6:
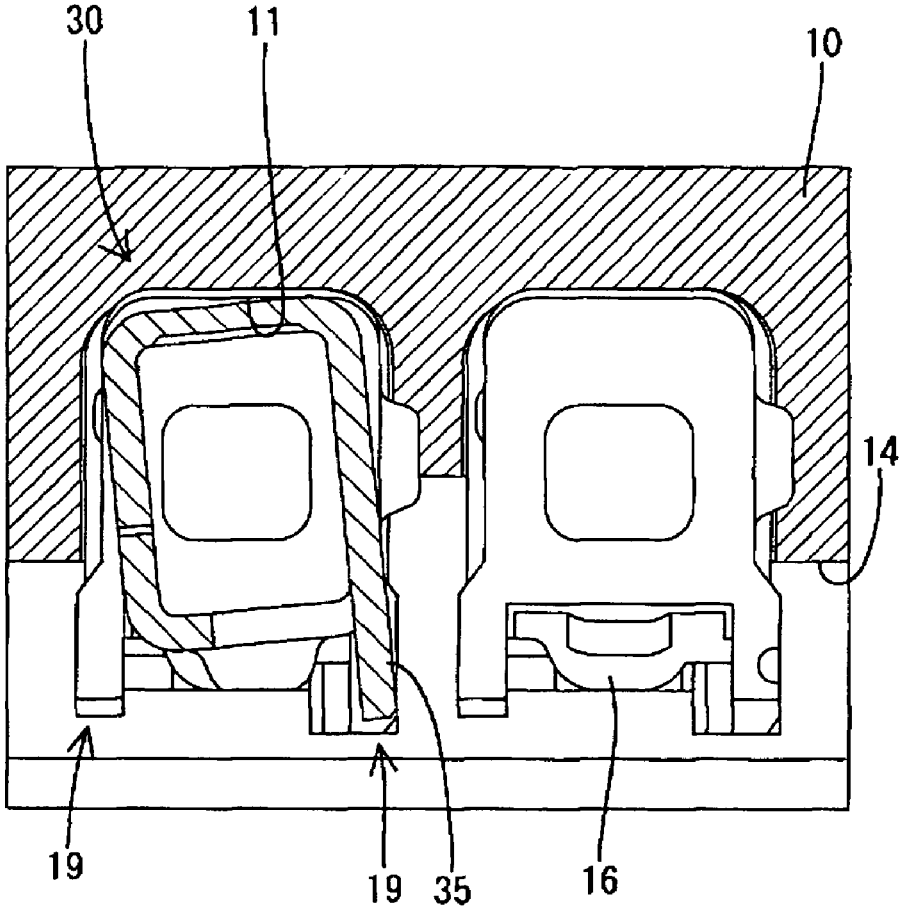
FIG. 6 is a section showing a comparative example not having a function of suppressing the inclination of the terminal fitting.

In view of the above, the terminal fitting 30 is formed with the stabilizer 35 that enters the mold-removal space 19 formed during the molding of the lock 16. Additionally, the protrusion 21 is formed on the inner wall of the mold-removal space 19 for contacting the stabilizer 35. The contact between the stabilizer 35 and the protrusion 21 suppresses the inclination of the terminal fitting 30, as shown in FIG. 5.

The stabilizer 35 prevents the terminal fitting 30 from being inserted into the cavity 11 in an improper posture and also suppresses or prevents inclination of the terminal fitting 30. Thus, the shape of the terminal fitting 30 is simpler as compared to a case where a projecting piece separate from the stabilizer 35 is provided to suppress inclination.

The protrusion 21 is a narrow rib substantially parallel with the inserting direction ID of the terminal fitting 30.

Thus, the projecting piece will not achieve more than a line contact with the protrusion 21 in the inserting process of the terminal fitting 30. Thus, a sliding resistance between the protrusion 21 and the projecting piece is low.

The invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

Although the stabilizer is the projecting piece in the foregoing embodiment, the projecting piece may be separate from the stabilizer according to the present invention.

The protrusion is formed only in one of the left and right mold-removal spaces in the foregoing embodiment. However, the terminal fitting may have left and right stabilizers, and both left and right mold-removal spaces may have protrusions. The stabilizers may be caused to enter the corresponding mold-removal spaces.

The mold-removal spaces communicate with the rear ends of the cavities in the foregoing embodiment. However, the invention is also applicable to connectors with mold-removal spaces that communicate with front ends of cavities.

The protrusion is formed on the surface of the mold-removal space opposite from the lock in the foregoing embodiment. However, the protrusion may be formed on the side surface of the lock according to the invention.

The left and right mold-removable spaces (excluding the protrusion) are transversely asymmetric in the foregoing embodiment. However, they may be transversely symmetric according to the invention.

The protrusion is substantially semicircular or rounded when viewed in the inserting direction ID of the terminal fitting in the foregoing embodiment. However, the protrusion may have a cross section that is rectangular, trapezoidal, rectangular or other shape.

The lock is supported at both front and rear ends in a bridge-like manner in the foregoing embodiment. However, the invention is also applicable to connectors with cantilevered locks.

Female terminal fittings are described in the foregoing embodiment. However, the invention also is applicable to connectors with male terminal fittings that have narrow tabs at their front ends.

The outer side surface of the stabilizer faces the protrusion with a small clearance defined when the terminal fitting is neither transversely displaced nor inclined with respect to the cavity in the foregoing embodiment. However, the stabilizer may be substantially in contact with the protrusion according to the present invention.

The inner side surface of the stabilizer substantially faces the side surface of the escaping space with a small clearance when the terminal fitting is neither transversely displaced nor inclined with respect to the cavity in the foregoing embodiment. However, the inner side surface of the stabilizer may be substantially in contact with the side surface of the escaping space according to the present invention.

What is claimed is:

1. A connector comprising a housing made of a synthetic resin and formed with at least one cavity and a lock extending substantially along an inner wall of the cavity, at least one terminal fitting configured for insertion into the cavity and for engagement by the lock, wherein:

the terminal fitting has at least one projection disposed and configured to enter a mold-removal space formed by molding the lock, an escaping space formed by recessing a side surface of the mold-removal space to widen the mold-removal space substantially alone a widthwise direction, a protrusion formed on the inner wall of the mold-removal space and opposed to the projection, and a clearance between the projection and an inner side surface of the escaping space and a clearance between the outer side surface of the projection and the protrusion being substantially equal to a clearance between the outer surface of a substantially rectangular tube of the terminal fitting and an inner surface of the cavity.

2. The connector of claim 1, wherein the projection is a stabilizer for preventing the terminal fitting from being inserted into the cavity in an improper posture.

3. The connector of claim 1, wherein the protrusion is a long narrow rib extending substantially parallel with an inserting direction of the terminal fitting into the cavity.

4. The connector of claim 1, wherein a projecting distance of the protrusion is larger than the clearance between the terminal fitting and the cavity and substantially equal to a thickness of the projection.

5. The connector of claim 1, wherein an outer surface of the mold-removal space is more outward than the side surface of the cavity.

6. The connector of claim 1, wherein a projecting distance of the protrusion is larger than the clearance between the terminal fitting and the cavity and is substantially equal to a thickness of the projecting piece.

7. A connector, comprising:

a synthetic resin housing having opposite front and rear ends, at least one cavity extending through the housing from the front end to the rear end, a resiliently deformable lock projecting onto the cavity, a mold-removal space extending into the rear end of the housing for forming at least one surface of the lock;

a terminal fitting configured for insertion into the cavity and for engagement by the lock, the terminal fitting having a stabilizer disposed and configured to enter the mold-removal space when the terminal filling is oriented properly relative to the cavity and disposed and configured to contact the rear end of the housing when the terminal fitting is oriented improperly; and a protrusion formed unitarily on an inner wall of the mold-removal space to contact the stabilizer to limit transverse movement of the terminal fitting in the cavity.

8. The connector of claim 7, wherein the protrusion is a long narrow rib extending substantially parallel with an inserting direction of the terminal fitting into the cavity.

9. The connector of claim 8, wherein a projecting distance of the protrusion is larger than a clearance between the terminal fitting and the cavity and substantially equal to a thickness of the stabilizer.

10. The connector of claim 9, wherein an outer surface of the mold-removal space is more outward than the side surface of the cavity.

11. The connector of claim 10, wherein an escaping space is formed by recessing a side surface of the mold-removal space so as to widen the mold-removal space substantially along a widthwise direction.

12. The connector of claim 11, wherein the terminal fitting is a female terminal fitting and has a substantially rectangular tube adjacent a front end thereof, a clearance between the stabilizer and an inner side surface of the escaping space and the clearance between the outer side surface of the stabilizer and the protrusion are substantially equal to a clearance between an outer surface of the rectangular tube and an inner surface of the cavity.

13. The connector of claim 1, wherein a projecting distance of the protrusion is larger than the clearance between the terminal fitting and the cavity and is substantially equal to a thickness of the stabilizer.

* * * * *